United States Patent [19]

Shimosaka et al.

[11] Patent Number: 5,018,561

[45] Date of Patent: May 28, 1991

[54] VENEER LATHE

[75] Inventors: Satoru Shimosaka, Obu; Yukinobu Kuno, Nagoya; Yukio Takagi, Obu; Masuo Mizuno, Nagoya, all of Japan

[73] Assignee: Meinan Machinery Works, Inc., Obu, Japan

[21] Appl. No.: 530,370

[22] Filed: May 30, 1990

[30] Foreign Application Priority Data

May 31, 1989 [JP] Japan ..... 1-140160

[51] Int. Cl.[5] ..... B27L 5/00

[52] U.S. Cl. ..... 144/209 R; 144/213; 144/356; 144/365

[58] Field of Search ..... 144/209 R, 213, 356, 144/357, 365

[56] References Cited

U.S. PATENT DOCUMENTS

| | | | |
|---|---|---|---|
| 3,073,363 | 1/1963 | Lofstedt | 144/209 R |
| 3,110,330 | 11/1963 | Neth et al. | 144/209 R |
| 3,198,226 | 8/1965 | Haumann | 144/209 R |
| 3,506,045 | 4/1970 | Bosco | 144/209 R |
| 4,901,777 | 2/1990 | Kolke | 144/209 R |

FOREIGN PATENT DOCUMENTS 62-64080 9/1988 Japan .

*Primary Examiner*—W. Donald Bray
*Attorney, Agent, or Firm*—Pennie & Edmonds

[57] ABSTRACT

In a veneer lathe having a pair of left and right double spindles, a small spindle is inserted in a large spindle in such a manner that the small one is relatively transferred in the axial direction freely and also is relatively rotated freely in the structure of the large one. Either one of the large or small spindle is driven at the one side of the left and right sides by a driving source at a required revolution.

18 Claims, 2 Drawing Sheets

VENEER LATHE

FIELD OF THE INVENTION

The present invention relates to an improvement provided for a veneer lathe.

BACKGROUND OF THE INVENTION

The known veneer lathes may be divided into two types: a conventional veneer lathe in which all the driving power required for cutting a log is supplied to the axial portion of a log only through spindles, and a peripheral driving type veneer lathe in which a peripheral driving mechanism is provided for supplying at least a part of the driving power required for cutting the log to the outer circumferential surface of a log through a peripheral driving member of an appropriate shape which is engaged with the outer circumferential surface of the log immediately before the cutting operation (just in front of the tip of a tool for the cutting) as disclosed, for example, in Japanese Patent Publication No. 16729/1981, and Japanese Patent Publication No. 27161/1988.

Irrespective of the types, however, it is desirable to have the so-called double spindle comprising two spindles, large and small, being interchangeably applied as required in order to securely hold logs of various sizes for cutting.

Nevertheless, the conventional double spindle is so structured that the two spindles, large and small, are rotated together with the small spindle being inserted in the inside of the large spindle in such a manner that it is relatively transferred freely in the axial direction but not relatively rotated. Therefore, although their structure is simple, the total inertial resistance is great, making it unsuitable to use them at a high-speed rotation simply because such a high-speed rotation with a great inertial resistance cannot be controlled with ease. As a result, they have a disadvantage in that the operation becomes less economical and productive.

In other words, the conventional veneer lathe, for example, needs an arrangement of driving devices of large capacity in its driving system because it is required to rotate said double spindle always against the total inertial resistance thereof. Naturally, therefore, the power consumption becomes uneconomically great. In addition, when the small spindle is in use, the large spindle and its driving system having an extremely great inertial resistance must be rotated simultaneously. Consequently, the incremental ratio of revolution has to be kept low or the maximum revolution should be limited to a lower level leading to a reduction in the machining rate of veneer, and the productivity becomes low after all.

The same situation exists in the veneer lathe of said peripheral driving type. For example, when the double spindle is positively rotated, the arrangement of driving devices and the power consumption are not economical. The problem of a lower productivity still exists when the small spindle is used. Particularly in view of rationalization of processing veneer, it is desirable to get a constant speed of single board machining by adopting a structure in which the driving speed of a log in the peripheral driving device is set at a constant speed and further the double spindle is driven rotatable under the revolution corresponding to the log-driving speed. But because difficulty in exerting following control of the revolution in the high speed ratio region it is necessary to select a less than optimum speed.

More precisely, if the machining speed of veneer is assumed to be set, for example at 110 m/min., the revolution of a spindle required to hold a log of 28 cm diameter is approximately 125 rpm, and likewise, if the diameter of a log is 25 cm, approximately 140 rpm, if the diameter is 22 cm, approximately 160 rpm, if the diameter is 19 cm, approximately 185 rpm, and if the diameter is 16 cm, it is approximately 220 rpm. Therefore, when the large spindle (usually 18 cm to 15 cm in diameter) is used, its absolute value and relative incremental ratio are not so large. But at 13 cm diameter, the required revolution becomes approximately 270 rpm, at 10 cm diameter, approximately 350 rpm, and at 7 cm diameter, approximately 500 rpm, so that when the small spindle (usually 8 cm to 5 cm in diameter) is used, the absolute value and relative incremental ratio become greater rapidly.

And if the small spindle of a conventional double spindle is rotated with the large spindle in a manner such as to follow said required revolution, it is needed to control driving devices of larger capacity precisely and, the more the revolution region becomes, the more conformingly, over a wider range of speed changes. To meet these requirements using generally available devices and techniques is extremely difficult. If, for example, revolution of the small spindle is increased beyond a required revolution, the driving force supplied to the axial portion tends to become too great, resulting in more breakage of the axial portion of a log. On the other hand, if the revolution is decreased below the required one, the driving force supplied to the outer circumferential surface tends to become too great, resulting in more damage to the surface of the log (veneer). In practical operation, such undesirable results as these should be prevented anyway.

Therefore, in order to meet the above-mentioned requirements using generally available devices and techniques, the absolute value of the required revolution is limited within a range where a follow-up rotational driving is possible, so that the machining speed of veneer is to be set at a value lower than practically required, or the incremental ratio of the required revolution is limited so that the minimum axial diameter of a log must be greater than the one usually used. The actuality, therefore, is such that the processing must be made at a constant speed which is not necessarily practical.

Furthermore, in some veneer lathes of the peripheral driving type, a structure is employed which is designed to interpose an overrunning mechanism in the driving system of the spindle, drive it rotatably at a random lower revolution that corresponds to the log-driving speed of the peripheral driving mechanism, and exert a follow-up rotation of the spindle via the log only at the time of operation of the peripheral driving mechanism. However, if a structure of this kind is provided with the conventional double spindle, the load of an inertial resistance of the large spindle still remains great when the small spindle is used, and the resulting power supply to the outer circumferential surface of the log tends to be extremely greater. Consequently, the damages on the surface of the log become vitaly conspicuous.

On the other hand, the known veneer lathe is so structured usually that a pair of left and right spindles are synchronously connected for rotation through a connecting rod and that both of the double spindles are relatively arranged with a step feeding mechanism which follows the rotation of both the double spindles when it is operated. If the axial portion of a log is broken by an excessive supply of driving power given thereto in the cutting process, the step feeding mechanism still follows the rotation of both of the double spindles irrespective of the difference which occurs between the revolutions of both of the double spindles and the log. As a result, there occurs an abnormal pressure between both of the double spindles and the step feeding mechanism, resulting in an undue wearing of such members as bearings, lead screw, and others and the breakage of an entire log.

SUMMARY OF THE INVENTION

The present invention provides means to solve all the known drawbacks of a conventional veneer lathe as mentioned above for the improvement of economy, productivity, and durability among others. Specifically, the present invention provides a veneer lathe having a pair of left and right double spindles. In the inside of a large spindle of each pair, a small spindle is inserted in such a manner that it is relatively transferred in the axial direction freely and also is relatively rotated freely. The veneer lathe is so structured that a peripheral driving mechanism is separately provided in order to supply to the outer circumferential surface of the log at least a part of driving power required for cutting the log (preferably at a substantially constant speed) through a peripheral driving member which is engaged with the outer circumferential surface of the log immediately before the cutting operation. At least one of the left and right pairs of double spindles is driven to rotate by a driving source at a required revolution (or, if necessary, at a revolution required in accordance with the driving speed of the log given by the peripheral driving mechanism). Preferably, either of the left and right pairs of spindles is idly rotated freely and each spindle of this idler side is arranged with a step feeding mechanism to follow the revolution of each spindle of said idler side in operation.

According to a veneer lathe with a double spindle having said structure, the two spindles, large and small, are rotated independently, and there is no fear that the inertial resistance of a spindle becomes any load against the rotation of the other spindle. Therefore, even if both of the spindles are arranged to be rotated, the total capacity of driving devices can be almost the same as conventionally required, and furthermore, the rotational driving of the side which is not in use can be stopped without a hitch. Especially, the inertial resistance of the small spindle is remarkably reduced so that the overall power consumption becomes small and an effectively economical operation can be carried out at a high speed with ease for an efficient machining of veneer.

Also, in the veneer lathe having a separate peripheral driving mechanism, the same effect is obtainable. Particularly, with the structure which provides a constant machining speed of veneer, it suffices if a rotational control is given for each of the two spindles, or an independent rotational control is given for each spindle by specifying a narrow range of speed changes at the time of using each spindle whenever necessary. An instantaneous control can be carried out in the region of a high-speed revolution with use of generally available devices and techniques. Therefore, there is no need for setting the machining speed of veneer at a lower speed than a practical value or for setting the minimum diameter of a log to be greater than usually required. As a result, a practically constant speed is applicable to the operation for a more effective machining.

Also, even if an exceptional structure is employed in order to allow a large or small spindle to follow the rotation of a log only when the peripheral driving mechanism is in operation, the operation is possible because there is almost no fear that the surface of the log is damaged due to the inertial resistance of each spindle. However, in view of the practicability required to cut a log of uneven circumferential surface smoothly, a driving system capable of driving to rotate said large spindle at a revolution required for the driving speed of the log given by the peripheral driving mechanism should preferably be provided at least for the large spindle.

On the other hand, if a structure is employed so that a step feeding mechanism is operated as set forth above, it is needless to mention that there is no particular problem about the slippage of a log, the supply of driving power etc., and even when the axial portion happens to be broken so that the revolution of a driven spindle becomes different from that of the log, the step feeding mechanism is always operated to follow the rotation of the spindle at the idler side. Therefore, no abnormal pressure takes place at all between the spindle and the step feeding mechanism, and there is no fear that any unnecessary wearing of every member or breakage of the entire log results, making it possible to carry out an effective operation.

BRIEF DESCRIPTION OF THE DRAWINGS

The present invention will subsequently be described according to an embodiment shown in the drawings.

DETAILED DESCRIPTION OF THE PREFERRED EMBODIMENT

Figure 1:
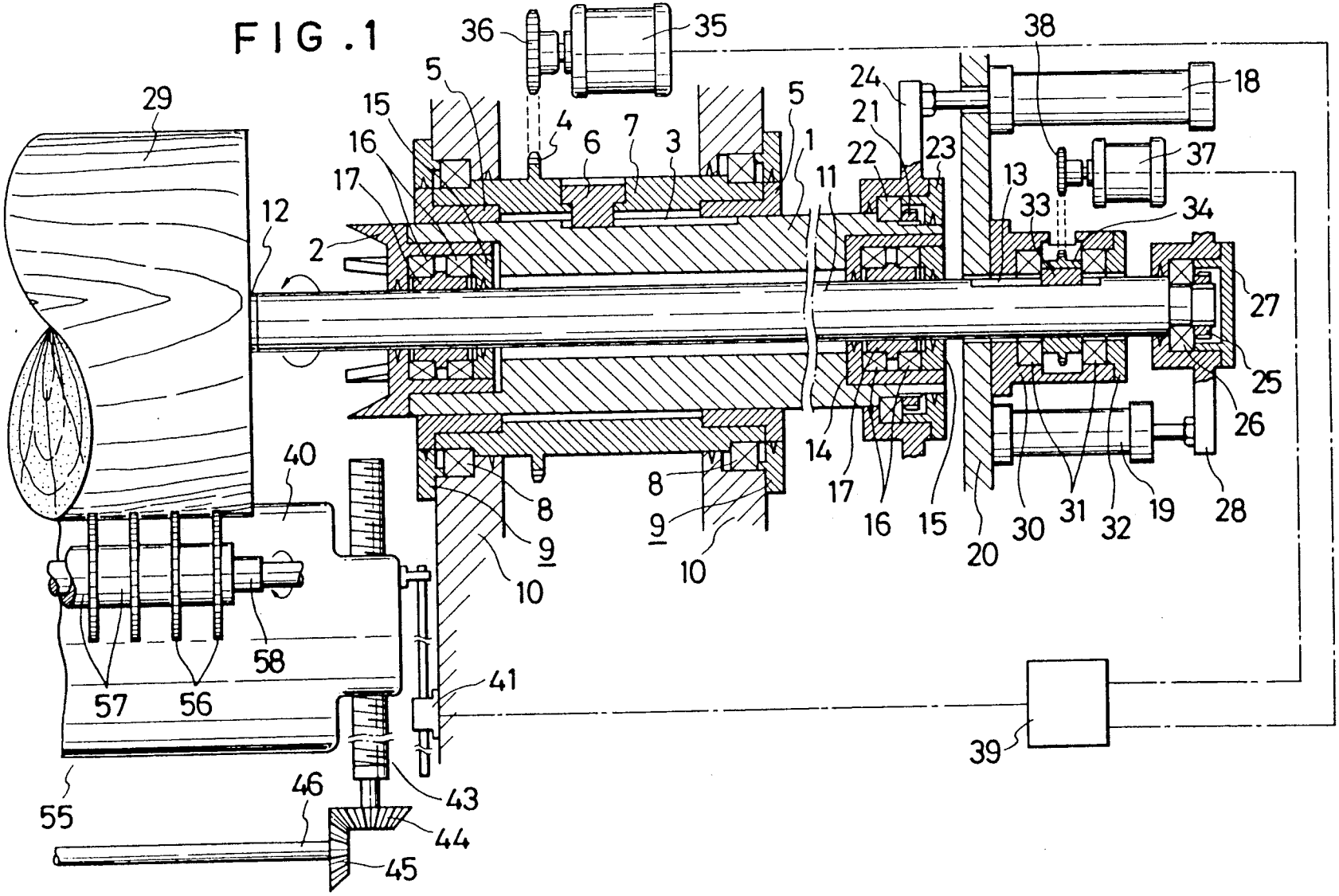
FIG. 1 is a partially cutaway plan view illustrating the right side of a veneer lathe according to the present invention.
Figure 2:
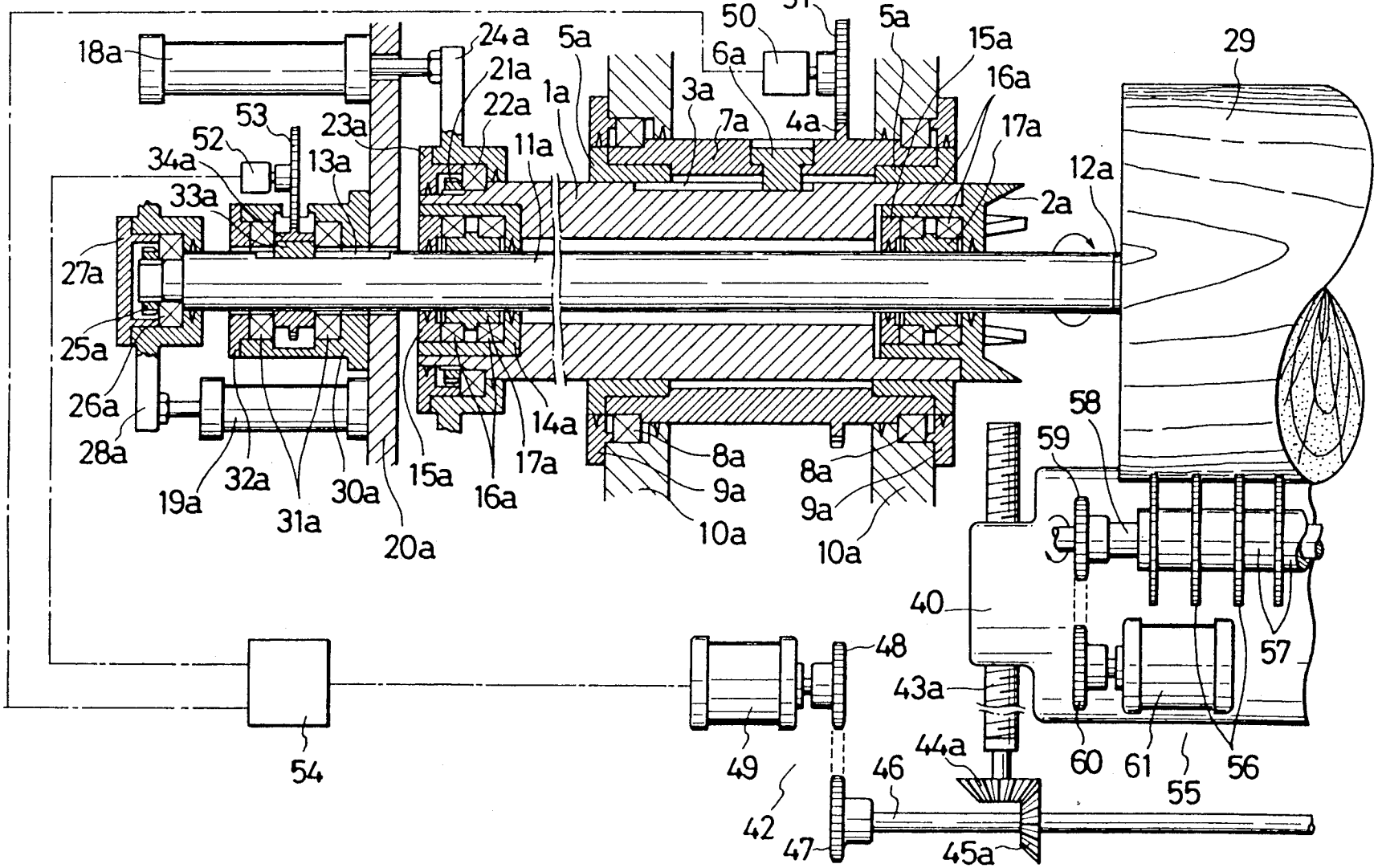
FIG. 2 is a partially cutaway plan view illustrating the left side of the veneer lathe shown in FIG. 1.

In the drawings, a pair of left and right large spindles 1, 1*a* has an appropriate number of keyways 3, 3*a* provided on the circumference thereof and large chucks 2, 2*a* are installed at both ends thereof which also function as bearing housing. Spindles 1, 1*a* are supported slidably only in the axial direction by a pair of sleeves 7, 7*a* each having a chain pulley 4 or a gear 4*a*, sleeve bearing 5, 5*a* and keys 6, 6*a*, and are rotatably supported simultaneously by main frames 10, 10*a* each having antifriction bearings 8, 8*a* and press-fit covers 9, 9*a* through the sleeves 7, 7*a* so as to hold a log 29 at both ends thereof by suitably transferring themselves in the axial direction as required following the operation of pushers 18, 18*a* which will be described later.

A pair of left and right small spindles 11, 11*a* has small chucks 12, 12*a* installed at both ends thereof as well as an appropriate number of keyways 13, 13*a* provided at the circumference thereof, and is supported slidably in the axial direction and also rotatably by said large spindles 1, 1*a* which have in addition to said large chucks 2, 2*a*, further bearing housings 14, 14*a*, press-fit covers 15, 15*a*, antifriction bearings 16, 16*a*, and sleeves 17, 17*a*. So small spindles 11, 11*a* can hold a log 29 at both ends thereof as required by transferring themselves in the axial direction following the operation of pushers 19, 19*a* which will be described later.

Pushers 18, 18*a* comprising hydraulic cylinders are mounted on subframes 20, 20*a* for transferring the large spindles 1, 1*a* as required in the axial direction through the bearing housing 24, 24*a*, containing antifriction bearings 22, 22*a* and press-fit covers 23, 23*a*, fixed to the large spindles 1, 1*a* by lock nuts 21, 21*a*.

Pushers 19, 19*a* comprising hydraulic cylinders are mounted on the subframes 20, 20*a* for transferring the small spindles 11, 11*a* as required in the axial direction through bearing housing 28, 28*a*, containing antifriction bearings 26, 26*a* and press-fit covers 27, 27*a*, fixed to the small spindles 11, 11*a* by lock nuts 25, 25*a*.

Bearing housings 30, 30*a* containing antifriction bearings 31, 31*a* and press-fit covers 32, 32*a* are mounted on subframes 20, 20*a* and hold a chain pulley 34 or a gear 34*a* arranged on the small spindles through keys 33, 33*a* rotatably but not slidably in the axial direction.

By means of variable speed driving power source 35 comprising a servo motor the large spindle 1 is driven at a required revolution through a chain pulley 36 and others depending on the control of a driving controller 39 which will be described later.

Another variable speed driving power source 37 comprising a servo motor and others drives the small spindle 11 at a required revolution through a chain pulley 28 and others by the control of a driving controller 39 which will be described later.

A driving controller 39 is provided for controlling said driving power source 35 or 37 in such a manner that it provides the large spindle 1 or the small spindle 11 with a revolution required for the outer circumferential speed of a log given by a peripheral driving mechanism 55, which will be described later, according to a detection signal from a position detecting tool 41 comprising an absolute position detector, a linear pulse encoder and others which substantially detect the size of a log 29 by the position of a planer stand 40.

A step feeding mechanism 42 is made up with a pair of left and right feeding threads 43, 43*a*, level gears 44, 44*a* and 45, 45*a*, a connecting shaft 46, chain pulleys 47, 48, and variable speed driving source 49 comprising a servo motor and others so as to feed the planer stand 40 back and forth in the direction towards the axial direction of the log or towards the circumference thereof depending on the control of a step-feeding controller 54 which will be described later.

A revolution detector 50 comprising a transducer and others detects the revolution of the large spindle 1*a* through a gear 51 and transmits a signal to the step-feed controller 54.

Another revolution detector 52 comprising a transducer and others detects the revolution of the small spindle 11*a* through gear 53 and transmits a signal to the step-feed controller 54.

A step-feed controller 54 is installed for controlling the driving source 49 of said step feeding mechanism 42 so as to give the feeding threads 43, 43*a* a predetermined revolution set in accordance with the thickness of the veneer. Feeding threads 43, 43*a* may follow the revolution of the log 29 accurately according to the signal from the revolution detector 50 or 52 in operation at the time of forward feeding (transfer in the direction towards the axial portion of the log) of the planer stand 40 for machining veneer, or may follow any specific or arbitrary revolution in accordance with a manual operation signal at the time of other forward feedings or backward feeding of the planer stand 40 (transfer in the direction towards the circumference of the log).

A peripheral driving mechanism 55 comprises a barbed roller type peripheral driving member 58 having a plurality of circular saw type peripheral driving tools 56 with many barbed bodies in shapes such as wedge, pyramid and others projectingly mounted on the circumference thereof through spacers 57 each provided at an arbitrary interval in the axial direction. Chain pulleys 59, 60 and a constant driving power source 61 made up with a three-phase electric motor are also provided. The peripheral driving member 58 is arranged in such a position that the barbed bodies of said peripheral driving tools 56 engage themselves with the outer circumferential surface of the log immediately before machining (or, if required, in the position where they can engage themselves with the surface of the veneer immediately after machining). By the actuation of an actuator (not shown), the peripheral driving member supplies a majority of the driving power required for machining the log 29 to the outer circumferential surface thereof at a substantially constant speed immediately before machining.

Furthermore, although the drawing is simplified for convenience's sake, each of said main frames is connected through a bed, and each of the subframes is integratedly arranged with each of the main frames. Also, each of said pushers is arranged in such a manner that it is provided symmetrically in a pair at the left and right sides and if required, each of them is positioned at right angles.

In the early stage of a cutting operation, the veneer are machined while the log is being held only by a large spindle or by both large and small spindles. Subsequently, at an appropriate time, the use of the large and small spindles is exchanged or the dual use of the large spindle is stopped, and the veneer are machined while the log is being held only by the small spindle.

At any rate, however, the two spindles, large and small, can be rotated independently, and there is no fear that the inertial resistance of either one of the spindles presents any problem of load against the rotation of the other spindle. Therefore, the total capacity of the driving devices is substantially identical to that of those used conventionally. Yet, the rotational driving of the spindle which is not in use can be stopped without a problem. Especially for the small spindle, the inertial resistance is remarkably reduced as compared with the conventional one so that the power consumption is generally small, making an economical operation possible.

Also, in this way, the machining speed of veneer is stabilized by the peripheral driving mechanism, and even in the case where the two spindles, large and small, are operated at a time, it suffices if the rotational control is carried out for each of them independently. Or in case where they are used interchangeably in principle, it suffices if a narrow range of speed changes is specified as required at the time of operating each spindle so as to carry out the rotational control for each spindle independently. Therefore, using generally available devices and techniques an instantaneous control of rotation can be conducted in the range of a high-speed revolution with ease. There is no need for setting the machining speed of veneer at a lower level than practically required or for setting the minimum diameter of a log at a greater value than normally required. As a result, the machining can be carried out at a practically constant speed for a more effective operation.

Furthermore, as set forth above, by the structure which allows the step feeding mechanism to operate following the revolution of a spindle at the side of idle rotation, it is needless to mention that there is no problem at all in relation to the slippage of a log in rotation, the power supply and others, of if there should occur any difference between the revolutions of the driving spindle and log due to the breakage of the axial portion of the log, any abnormal pressure does not take place at all between the spindle and the step feeding mechanism. Therefore, there is no fear that any undue wearing of parts or breakage of the entire log results, making it possible to carry out the operation more effectively.

In addition, if the small spindle is also structured to drive itself to rotate at a revolution to match the driving speed of the log given by the peripheral driving mechanism, it is possible to hold by the small spindles a log which is too thin to be suitable for the large spindles and is also uneven at its outer shape for constant machining. Although the number logs of this kind is comparatively small, this still is an advantage to mention. Generally, when the outer shape of a log becomes like a column with use of the large spindle, the small spindle takes over and holds it. Therefore, an overrunning mechanism can be provided in the driving system of the small spindle (for example, in the chain pulley 38 of said embodiment) so as to set an arbitrary revolution for the rotational driving at a smaller revolution than that of for the driving speed of the log given by the peripheral driving mechanism. This mechanism can be provided without a problem in practice and makes it unnecessary to have a control so as to follow the revolution of the small spindle. Then, there is no need for any devices exclusive for such a control, and the operation becomes more economical.

Also, if the system is so structured that a majority of the driving power required to cut a log is supplied to the outer circumferential surface of the log with the peripheral driving mechanism, the log can effectively be cut more constantly until it becomes thin. If the structure is further made to allow the peripheral driving mechanism to run at a substantially constant speed for driving the log, it becomes convenient to rationalize the process required for the veneer treatment after the veneer lathe machining. However, the ratio of power supply for the peripheral driving mechanism and the driving speed of the log are not necessarily limited to those conditions as described. Their design can be modified appropriately, or since there is no fear that the intertial resistance of either one of the spindles presents any problem of load against the rotation of the other spindle, the machining of veneer can efficiently be carried out with a more economical power consumption as compared with a veneer lathe conventionally in use.

It is needless to mention that the manner in which the peripheral driving mechanism and the step feeding mechanism are provided is not necessarily limited to the one in said embodiment. It can be modified appropriately to any other ones conventionally known. The design of any other members can also be modified appropriately without departing from the purport of the present invention.

We claim:

1. A veneer lathe, comprising:

means for rotatably supporting a log comprising first and second sets of spindles, each of said sets comprising at least one inner spindle concentric and axially and rotatable movable within an axially and rotatable movable outer spindle, and means for selectively engaging the log with at least one of said inner or outer spindles;

means for rotating the log; and means for cutting the log while the log is rotating.

2. The veneer lathe of claim 1, wherein said rotating means comprise a peripheral driving mechanism for supplying at least a portion of the driving power required for cutting the log through engagement with a circumferential surface of the log.

3. The veneer lathe of claim 2, further comprising means for detecting the revolution of at least one of said spindles, operatively associated with means for controlling the rate at which said cutting means is moved toward the log.

4. The veneer lathe of claim 2, wherein the peripheral driving mechanism includes means for providing a substantially constant driving speed to the log.

5. The veneer lathe of claim 2, wherein said rotating means further comprises means for rotatably driving at least one of said spindles to provide an additional portion of the driving power.

6. The veneer lathe of claim 5, wherein the inner and outer spindles of the first set of spindles are freely rotatable, and the inner and outer spindles of the second set of spindles are independently and drivably rotatable.

7. The veneer lathe of claim 6, further comprising means for detecting the circumferential speed of the log operatively associated with means for rotating at least one spindle of said second set of spindles at a speed corresponding to said circumferential speed.

8. The veneer lathe of claim 7, further comprising means for detecting the revolution of at least one of said spindles, operatively associated with means for controlling the rate at which said cutting means is moved toward the log.

9. Apparatus for supporting and rotating a log in a veneer lathe, comprising:

first and second pairs of spindles, each pair comprising an inner spindle and an outer spindle, each spindle being independently axially and rotatably movable; and means for independently and axially moving the inner and outer spindles of at least the first pair of spindles to selectively engage a log and support said log between at least one spindle of said first pair and at least one spindle of said second pair.

10. The apparatus of claim 9, further comprising means for rotating said log.

11. The apparatus of claim 10, wherein said log rotating means comprises a peripheral driving mechanism for supplying at least a portion of the driving power required to rotate the log for subsequent cutting thereof.

12. The apparatus of claim 10, wherein said log rotating means comprises means for rotating at least one of said spindles to cause rotation of said log.

13. The apparatus of claim 12, wherein said axial moving means comprises means for cooperatively moving said inner spindles toward and away from each other, and means for independently cooperatively moving said outer spindles toward and away from each other.

14. The apparatus of claim 13, wherein said spindle rotating means comprises means for independently rotating each of the inner and outer spindles of at least one pair of spindles.

15. The apparatus of claim 14, wherein one of said pairs of spindles is drivable by said spindle rotating means and the other of said pairs of spindles is freely rotatable.

16. The apparatus of claim 15, further comprising means for cutting the log while the log is rotating, and means for detecting the rate of revolution of at least one of said freely rotatable spindles, operatively associated with means for controlling the rate at which said cutting means is moved toward the log.

17. The apparatus of claim 16, wherein said rotating means further comprises a peripheral driving mechanism to provide an additional portion of the driving power through engagement with a circumferential surface of the log.

18. The apparatus of claim 17, further comprising means for detecting the circumferential speed of the log and for rotating at least one of said drivable pair of spindles at a speed corresponding to said circumferential speed.

* * * * *